US008449141B1

(12) United States Patent
Hinrichs

(10) Patent No.: US 8,449,141 B1
(45) Date of Patent: May 28, 2013

(54) INTELLIGENT LIGHT FIXTURE WITH MANUAL FOLLOW SPOT FUNCTION

(75) Inventor: Matthias Hinrichs, Prior Lake, MN (US)

(73) Assignee: Martin Professional A/S, Aarhus N. (DK)

( * ) Notice: Subject to any disclaimer, the term of this patent is extended or adjusted under 35 U.S.C. 154(b) by 0 days.

(21) Appl. No.: 13/378,184

(22) PCT Filed: Apr. 13, 2010

(86) PCT No.: PCT/DK2010/050081

§ 371 (c)(1),
(2), (4) Date: Feb. 1, 2012

(87) PCT Pub. No.: WO2010/145658

PCT Pub. Date: Dec. 23, 2010

(30) Foreign Application Priority Data

Jun. 18, 2009 (DK) ..... 2009 00748

(51) Int. Cl.
*F21V 1/00* (2006.01)

(52) U.S. Cl.
USPC ..... 362/235; 362/283; 362/268; 362/281

(58) Field of Classification Search
USPC ..... 362/235, 277, 268, 282
See application file for complete search history.

(56) References Cited

U.S. PATENT DOCUMENTS 5,980,066 A 11/1999 Belliveau
6,866,402 B2 3/2005 Belliveau

FOREIGN PATENT DOCUMENTS

EP 1001212 5/2000
JP 9063303 3/1997

OTHER PUBLICATIONS

International Search Report; International Application No. PCT/DK2010/050081; International Filing Date Apr. 13, 2010; 8 pages.
Written Opinion; International Application No. PCT/DK2010/050081; International Filing Date Apr. 13, 2010; 10 pages.
English Abstract of Foreign Patent Document JP9063303 (1 page).

*Primary Examiner* — Evan Dzierzynski
(74) *Attorney, Agent, or Firm* — Blank Rome LLP

(57) ABSTRACT

The present invention relates to entertainments systems comprising a light controller connected to at least one moving head light fixture through a communication channel and to moving head light fixtures, where a moving head comprises switching means for switching said moving head between a normal mode of operation and a follow spot mode of operation, said follow spot mode of operation being characterized in that at least said first rotating means or said second rotating means being deactivated. In is thus possible to use the moving head as both an automatic moving head an as a manual moved follow spot. The moving head comprises also position encoding means determining to position of the moving head and other moving heads in the entertainment system thus be controlled based on the position of the first moving head.

24 Claims, 5 Drawing Sheets

INTELLIGENT LIGHT FIXTURE WITH MANUAL FOLLOW SPOT FUNCTION

FIELD OF THE INVENTION

The present invention relates to entertainments systems comprising a light controller connected to at least one moving head light fixture through a communication channel and to moving head light fixtures.

BACKGROUND OF THE INVENTION

Spot lights that illuminant a person or a certain area of a stage are commonly known within the entertainment industry. Such spot lights typical comprise a light source creating a beam of light that is used to create various optical effects. The light source is integrated into an optical system which typical comprises a number of optical elements, such as reflectors, color filters, dimmers, lenses, beam shaping elements etc., for forming the light beam. Some of these optical elements can typical be adjusted manual by a person whereby the appearance of the light beam can be change changed.

Spot lights are often used as follow spots by mounting a spot light on an arrangement allowing the spot light to be paned and tilted. The follow spot can thus be manual panned and tilted and moving objects can thereby be followed by the light beam.

Intelligent light fixtures like moving head comprise also a light source and optical elements generating a light beam. The operation of the light source and optical elements has been automated as known in the art and such moving heads are typical electronically coupled to the light controller that can control a large number of moving heads. A light show can be programmed on the light controller and the light controller will automatically send control signals to the moving heads.

Moving heads is also used as follow spots following a moving person on a stage, but these moving heads need to be programmed at the lighting controller in order to move. The moving head will thus move in a predetermined pattern and the person/artist thus need to move in the same pattern as the moving head to be in the spot light. However many artists often improvise his/her way of moving or forgets the predetermined moving pattern and the person will as a consequence not be correct illuminated by the follow spot.

A light show therefore often comprises both manual follow spots which are only used when the follow spot function is needed and a number of moving heads which are only used in the preprogrammed light show. This is both expensive and takes a lot of space in connection with the show. Further it is often necessary to have more than one spot light following the same artist which thus needs many persons manually operating the manual follow spots. It has previous been attempted to construct several full automated follow spot systems, where the moving heads automatic follows an artists but none of these systems have been able to function properly.

U.S. Pat. No. 6,866,402B discloses a multi parameter lighting fixture, which includes a locking system for pan and/or tilt, either of which may include a manual input device and an actuator. The locking systems for pan and tilt can be manually locked or unlocked by a technician using their respective manual input devices and automatically locked or unlocked by their respective actuators. A yoke of the multi parameter lighting fixture can be locked in more than one rotational position in relation to the base housing. In addition, the lamp housing of the multi parameter lighting fixture can be locked in more that one rotational position in relation to the yoke.

The locking systems for pan or tilt can be automatically locked by an appropriate actuator in response to an electronic control system.

EP1001212 discloses an automated lighting fixture which automatically locks specific moving part(s) into fixed position(s) when power is not supplied to facilitate packaging, shipping, load-in and load-out of the fixtures. These light fixtures is locked into fixed positions in order to maintain a fixed position during transportation, storage or repair and can not be used as follow spots and are the light source ore further turned off when locked in these fixed positions.

JP9063303 discloses a master spotlight that is, remotely operated and is swing-driven, the master spotlight detects a drive angle by a swing drive, and outputs the same to a controller unit as a position detection signal. Based on the position detection signal, the unit outputs drive control signals to slave spotlights. Based on the drive control signals, the slave spotlight drive control portions control the swing drives so that the spotlight radiation directions follow the radiation direction of the master spotlight

DESCRIPTION OF THE INVENTION

The object of the present invention is to solve the above described problems. This can be achieved by invention as defined by the independent claims and the benefits and advantages of the present invention are disclosed in the detailed description of the invention.

Specific embodiments of specified by the dependent claims and the benefits and advantages of these are also disclosed in the detailed description.

DETAILED DESCRIPTION OF THE INVENTION

Figure 1:
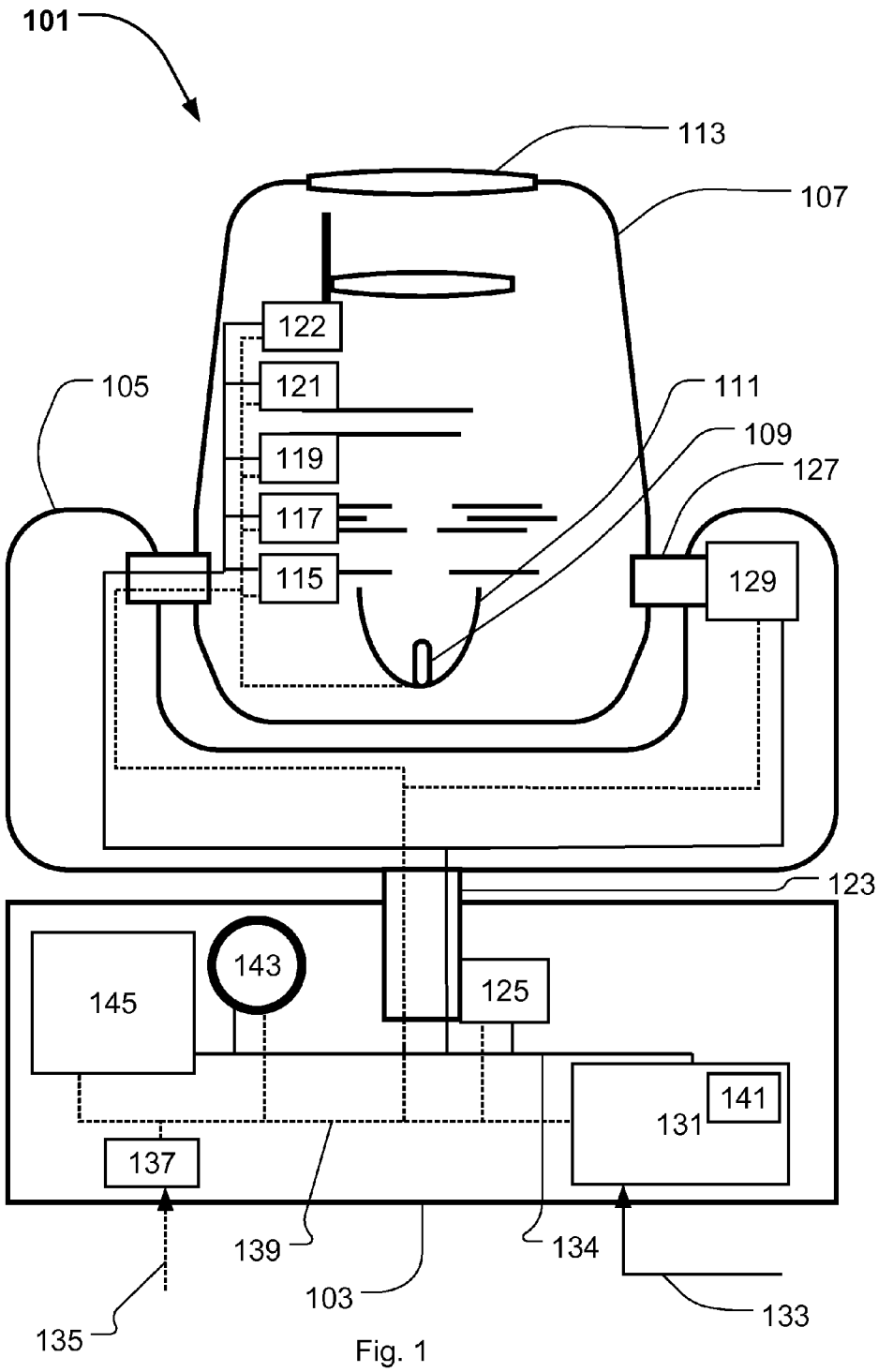
FIG. 1 illustrates a first embodiment of moving head light fixture according to the present invention.

FIG. 1 is a structural diagram illustrating a moving head light fixture 101 according to the present invention. The moving head light fixture 101 comprises a base 103 connected to a yoke 105 and a head 107 carried in the yoke. The head comprises at least one light source 109 which generates a light beam (not shown). The light beam is reflected by a reflector 111 and passes through a number of light effects before exiting the head through a lens 113. The light effects could for instance any light effects known in the art of intelligent lighting for instance a dimmer 115, a CMY color mixing system 117, color filters 119, gobos 121 and/or a zoom system 122. The light source can be any known light sources e.g. discharge lamps, LEDs, OLEDS, plasma lamps, lasers etc. The reflector can be any kind of reflectors and in some applications also be embodies as optical lenses such as TIR lenses.

The moving head light fixture comprises first rotating means for rotating the yoke in relation to the base, for instance by rotating a shaft 123 connected to the yoke by using a motor 125 positioned in the base. The moving head light fixture comprises also second rotating means for rotating the head in relation to the yoke, for instance by rotating a shaft 127 connected to the head by using a motor 129 positioned in the yoke. The skilled person would realize that the rotation means can be constructed in many different ways using mechanical components such as motors, shafts, gears, cables, chains, transmission systems etc. The motor 125, 129 can be embodied as step motors whereby it is possible to control the position of the moving head very prices.

The moving head light fixture receives electrical power 135 from an external power supply (not shown). The electrical power is received by an internal power supply 137 which adapts and distributes electrical power through internal power lines 139 (dotted lines) to the subsystems of the moving head. The internal power system can be constructed in many different ways and the illustrated power lines is for simplicity illustrated as one system where all subsystems are connected to the same power line. However the skilled person realize that some of subsystems in the moving head need different kind of power. The light source will for instance in most applications need a different kind of power than step motors and driver circuits.

The light fixture comprises also a controller 131 which controls the other components (other subsystems) in the light fixture based on an input signal 133 indicative of at least one light effect parameter and at least one position parameter. The light effect parameter is indicative of at least one light effect parameter of said light beam for instance the amount of dimming and/or the dimming speed of the light beam, a color that the CMY system 117 should mix, the kind of color filter that the color filter system 119 should position in the light beam and/or the kind of gobo that the gobo system 121 should position in the light beam, the divergence of the light beam that light fixture should create using a zoom system 122, a focus distance that indicate the distance form the lens to a surface where a gobo effect should be imaged, etc. The controller is adapted to send commands and instructions to the different subsystems of the moving head through internal communication lines 134 (solid lines). The internal communication system can be based on a various type of communications networks/systems and the illustrated communication system is only one illustrating example.

The position parameter is indicative of a position of at least said yoke in relation to said base and/or a position of said head in relation to said yoke. The position parameter canfor instance indicate a position whereto the light fixture should direct the beam, the position of the yoke in relation to the base, the position of the head in relation to the yoke, the distance/angle that the yoke should be turned in relation to the base, the distance/angle that the head should be turned in relation the base etc. The position parameter could also indicate the speed and time of the rotation.

The moving head further comprises switching means for switching the moving head between a normal mode of operation and a follow spot mode of operation. The follow spot mode of operation being characterized in that at least the first rotating means or the second rotating means being deactivated while the controlling means adapted for control the light effect means remains at least partially activated. It is hereby achieved that the moving head light fixture can be both integrated into an entertainment system and take part of a light show controlled by a light controller and additionally also function as a follow spot that is moved manually.

The switching means 141 are in the illustrated embodiment integrated into the logic of the controller e.g. as a part of the controlling software. The switching means is adapted to switch the moving head between a normal mode of operation and a follow spot mode of operation. The controller 131 controls in the normal mode of operation the moving head light fixture based on the incoming input signal 133 indicative of at least one light effect parameter and at least one position parameter as described above. The moving head will thus in the normal mode of operation function as an automatic moving head as known in the prior art where the light effects will change according the light effect parameter and the fixture move according to the position parameter. The controller will in the follow spot mode deactivate the first and/or second rotating means whereby it is possible to manual move the moving head as it will not move according to the position parameter. The light effects can however still be changed based on the light effect parameter while the moving head is moved manually.

The switching means can deactivate the first and/or second rotating means in a number of different ways for instance by sending a deactivation signal to a driver controlling the rotating means. The deactivation signal instructs in this case the driver to ignore all position/moving signals received for a given period of time or until the driver receives an activation signal, or by instruction the controller not to send any position/moving signal internally inside the light fixture. In other words, the switching means will in the follow spot mode of operation make sure that the moving head ignores the positional parameters of the incoming input signal and at the same time still react on at least a part of the light effect parameters of the incoming input signal.

The switching means can for instance be activated by the incoming input signal 133 that sends a command to the controller 131 indicating that the switching means should switch the moving head between the normal mode of operation and the follow spot mode of operation. The input signal is thus indicative of at least one mode of operation parameter, where the operation parameter defines the mode of operation e.g. "normal mode" or "follow spot". The moving head can hereby be switched into follow spot mode by a light controller sending the input signal and the person manually moving the moving head light fixture does thus only concentrate on moving the moving head correctly. The input signal can implement according to one of the light control protocols defined below.

The moving head can also have user input means enabling a user to interact directly with the moving head instead of using a light controller (not shown) to communicate with the moving head. The user input means 143 can for instance be bottoms, joysticks, touch pads, keyboard, mouse etc. The switching means can also be activated based on such user input means and a user can therefore put the moving head light fixture into follow spot mode simply by pushing a bottom and thereafter use the moving head as a follow spot. This is very useful when the moving head is used both as an automatic light fixture in a light show controlled by a light controller when the moving head occasional is used as a follow spot, as the person manual operating the moving head in follow spot mode can switch the moving head into follow spot mode simply by activating a bottom. The user input means can also be supported by a display 145 enabling the user to interact with the moving head through menu system shown on the display using the user input means 143. The display device and user input means can in one embodiment also be integrated as a touch screen. The user interacting means can in one embodiment also be adapted to control at least some of the light effects and the controlling means adapted for control the light effect means will thus also ignore at least one type of light effect parameters received through the input signal. It in this way possible to allow the user to manual move the light fixture and provide at control bottom where the user for instance an control the size of an iris, intensity and color of the light beam etc. while the light controller controls the other light effect means.

Figure 2:
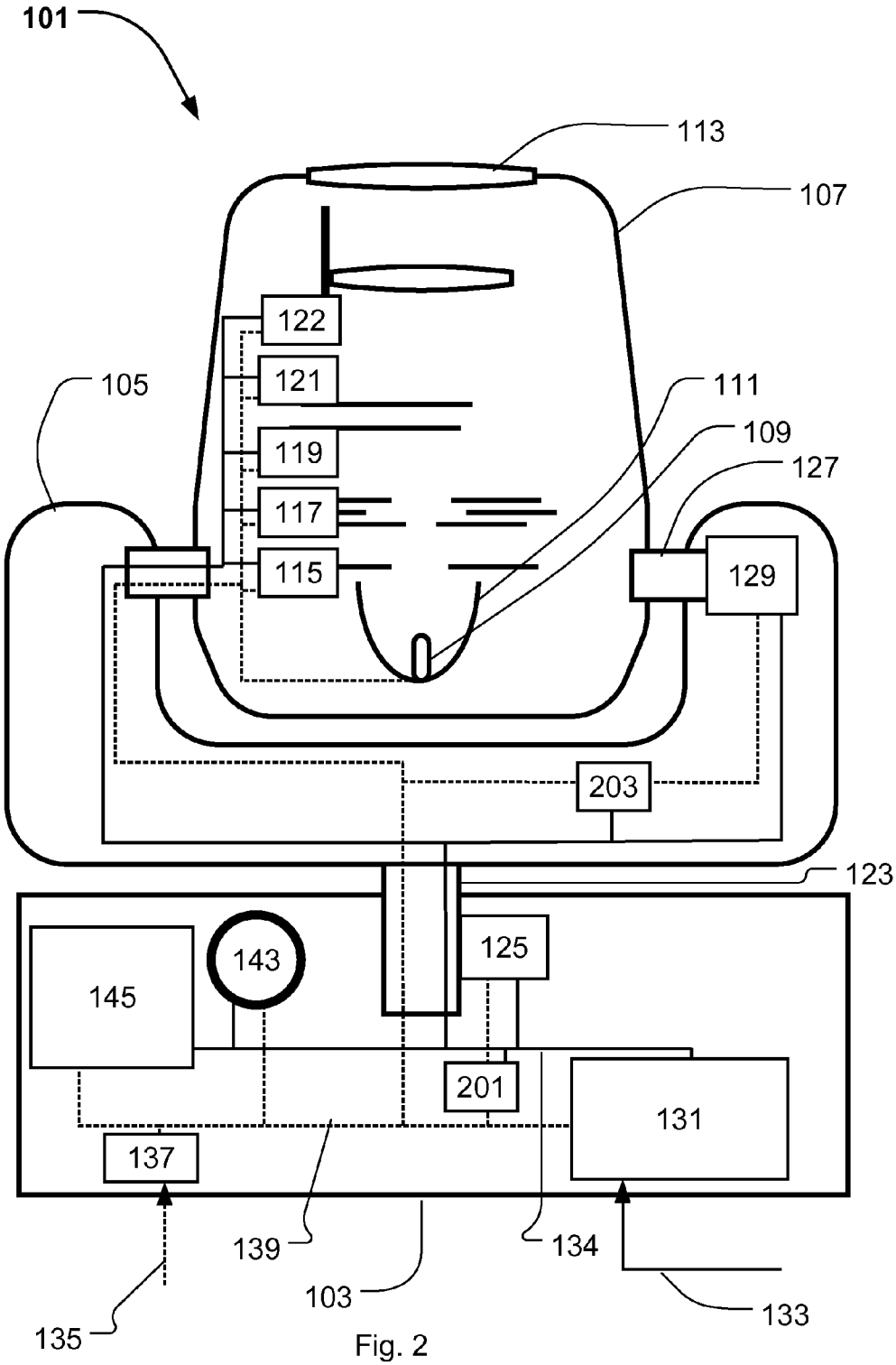
FIG. 2 illustrates a second embodiment of a moving head light fixture according to the present invention.

FIG. 2 illustrates a second embodiment of moving head light fixture of FIG. 1. The switching means comprises in this embodiment a first electronic switch 201 capable of switching on/off the power line to the first rotating means 125 and a second electronic switch 203 capable of switching on/off the power line to the second rotating means 127. The first and second electronic switch is both connected to the controller 131, and can thus be controlled by the controller. The first and second rotating means is therefore deactivated by cutting their power line and activated by reestablishing the power connection. The controller can thus switch the moving head into follow spot by cutting power to the rotating means and a user can thus manual move the moving head as described above. The controller can receive a signal indicating that the moving head should be switch between the normal modes and follow spot mode in a similar way as described above. The first and second electronic switches could alternatively be mechanically switches that turn the power to the rotating means on/off. The mechanically switches could also switches that could be turned manual from the outside of the moving head and thus not connected to the controller as illustrated.

The switching means can in an alternatively embodiment reduce the power/current to the motors in follow spot mode instead of turning the power off and at the same time ignore the position parameter from the input signal. The reduced current will cause the motors to hold back when a person moves the moving head. This will cause the fixture to stay in place steady and also give is some dampening and smoothness in operation by a manual user which is very convent in the case where the moving head is positioned unbalanced in the yoke. In one embodiment this reduced power/current can further be adjustable using the user input means whereby the user can adjust the amount that the moving head holds back. Also the moving head light fixture may also comprise position encoders as described below and use these position encoders to determine when the moving head is moved an and reduce or remove any power/current to the motors as soon as a small movement is made and reengage after a set amount of time or when the movement is stopped.

The moving heads illustrated in FIG. 1 and/or 2 can include first position encoding means (not shown) adapted to measure the position of the yoke in relation to the base and/or second position encoding means (not shown) adapted to measure the position of the head in relation the yoke. The first and second position encoding means can be connected to the controller 131 and send a position signal at least indicative of the position of the yoke in relation the base and/or indicative of the position of the head in relation to the yoke. The controller could for instance use the this signal to store the initial position of the head and yoke when the moving head is switched from normal mode to follow spot mode, and can thus return the moving head back to the initial position when switched back in to normal mode. The controller can further be adapted to hold the head and yoke in the current position when the person stops manually moving the moving head, where by the moving head automatic will be positioned in the current position. This is a useful function in the case that a person need manual to direct the light beam towards a specific position an thereafter maintain the moving head in this position. The controller can further send the position to a light controller through an output signal and the light controller is thus updated about the position of the moving head in real time, and does thus not need to restart/reboot the position of the moving head when the moving head is switched back to normal mode of operation. Another advantage of the real time update is the fact that the light controller can be adapted to control other moving heads based on this position signal, whereby is to possible manually to move a plurality of moving heads synchronous simply by manual moving one moving head.

Figure 3:
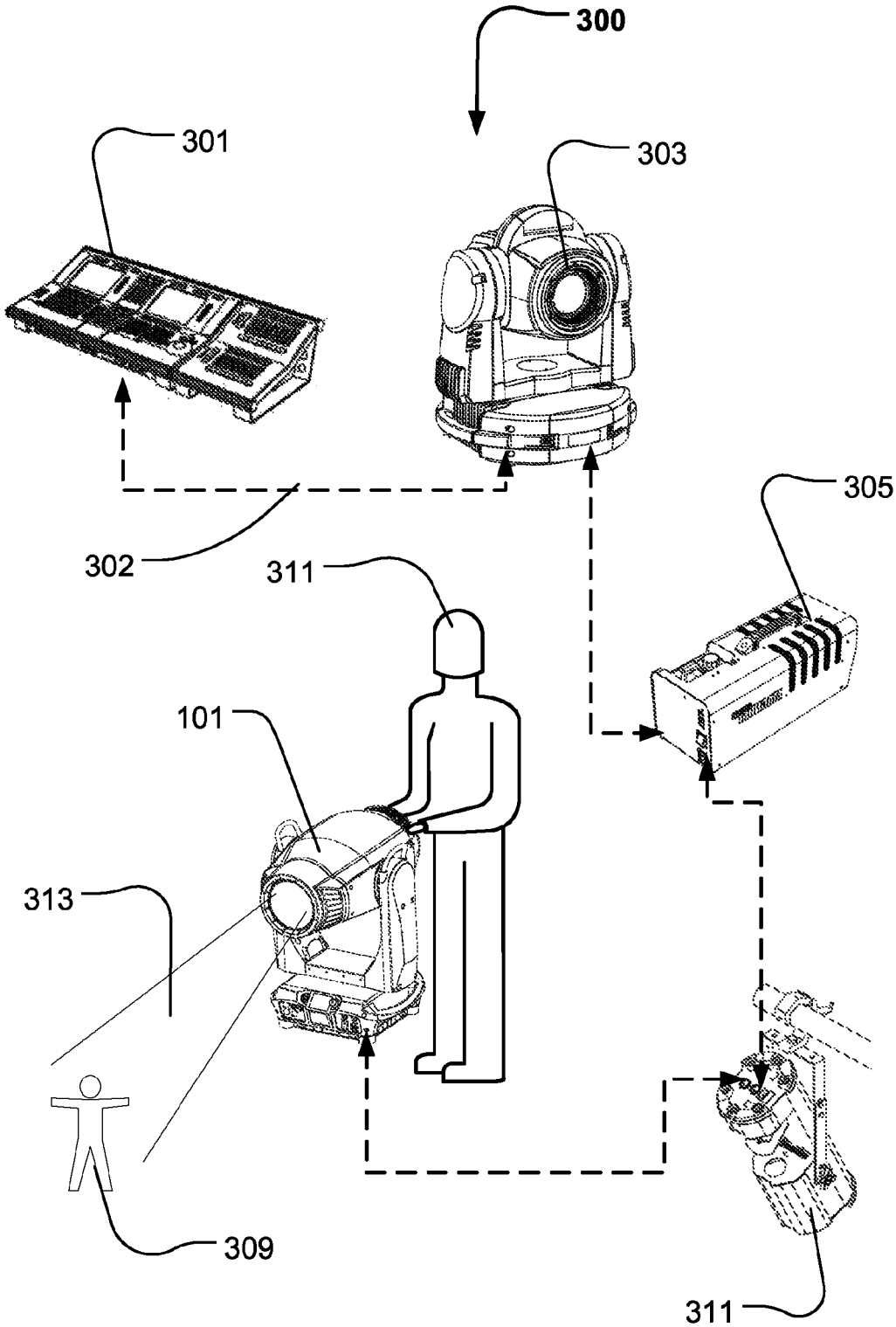
FIG. 3 illustrates an entertainment system comprising a moving head light fixture according to the present invention.

FIG. 3 illustrates an entertainment system 300 according to the present invention. The entertainment system 300 comprises a light controller 301 connected to a number of light effect apparatus such as moving heads 303, scanners 311 or the like and a number of smoke/fog/haze generators 305. The light controller controls the light effects apparatus and smoke generators using a light control signal 302 as known in the art. The light control signal could for instance be based any standard light control protocols such as DMX, ESTA ACN (Architecture for Control Networks—ANSI E1.17-2006), ArtNET or ArtNetII from Artistic. DMX refers to any of the standards known in the art such as USITT DMX 512, USITT DMX 512 1990, USITT DMX 512-A and DMX-512-A including RDM, as covered by ANSI E1.11 and ANSI E1.20 standards. The light control signal can also be web based whereby the moving head can be controlled through the internet, LAN or WLAN.

The entertainment system comprises further at least one follow spot moving head light fixture 101 having a normal mode of operation and a follow spot mode of operation as described above. The follow spot moving head light fixture can when in normal mode of operation be controlled by the light controller 301 and form a part of the light show similar as the other moving heads 303 in the entertainment system. The follow spot moving head has also a follow spot mode of operation where it can be moved manual by a person 311, such that the light beam 313 can be directed towards a performing artist 309. The person moving the follow spot moving head can thus follow the performing artist during the performance. The follow spot moving head can when there is no need for the follow spot function be switched back into normal mode of operation and the follow spot moving head can thus be controlled as any other moving head in the entertainment system.

Figure 4:
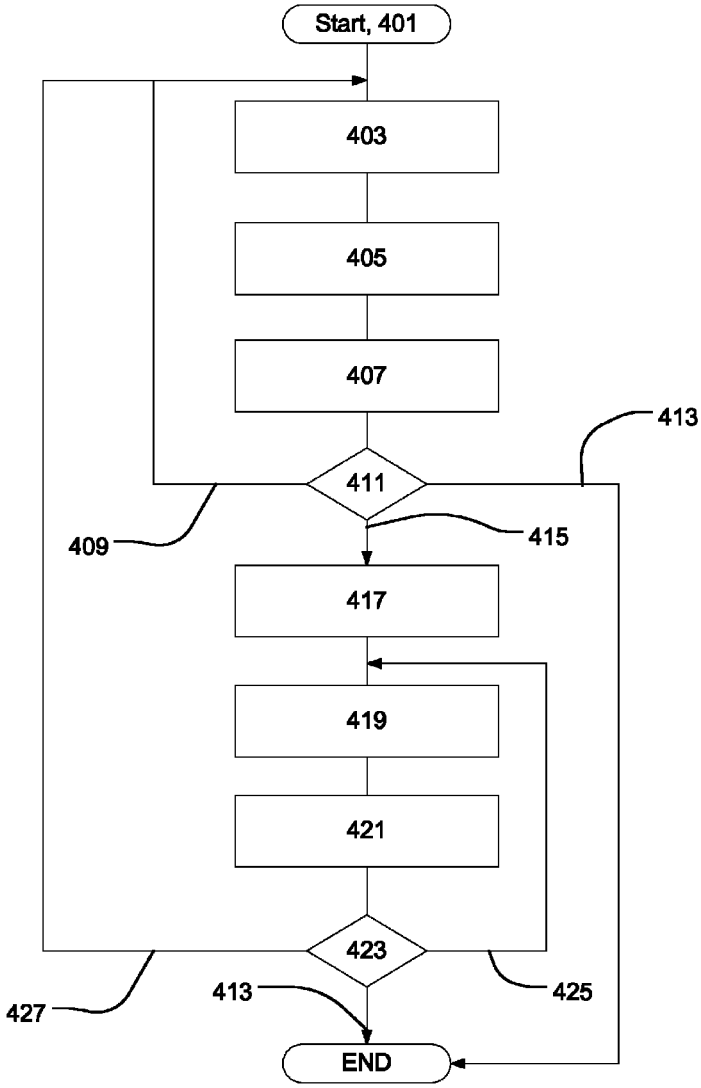
FIG. 4 is a flow diagram illustrating one method of operating the moving head according to the present invention

FIG. 4 is a flow diagram illustrating one method of operating the moving head according to the present invention. The moving head is first initialized in step 401. This step is typical performed when the moving head is turned on and could include communication between the moving head and light controller such as assigning a communication address to the moving head in a communication system. The moving head receives in step 403 an input signal indicative of at least a one light effect parameter and one position parameter, adjusts the optical effects of the moving head according to the light effect parameter in step 405 and adjust the position of the moving head according to the position parameter in step 407. Step 411 illustrates that step 403, 405 and 407 is repeated many times 409 until the moving head revises an instruction to stop the process 413 or the switch the moving head into follow spot mode 415. The moving head could for instance revive this instruction from the input signal revived from a light controller or by a user interacting with the moving head using user interaction means on the moving head. The moving head deactivates in step 417 the rotating means in any way described above if the revived instruction indicate that the moving head needs to be changed into follow spot mode. The position of the moving head is now manually moved by a person in step 419 and the optical effects are in step 421 are still adjusted according to an input signal. However some of the light effects may also be adjusted by a person in step 419. 423 illustrates that step 419 and 421 are repeated many times 425 until the moving head revises an instruction to stop the process 413 or the switch the moving head into normal mode of operation 427.

Figure 5:
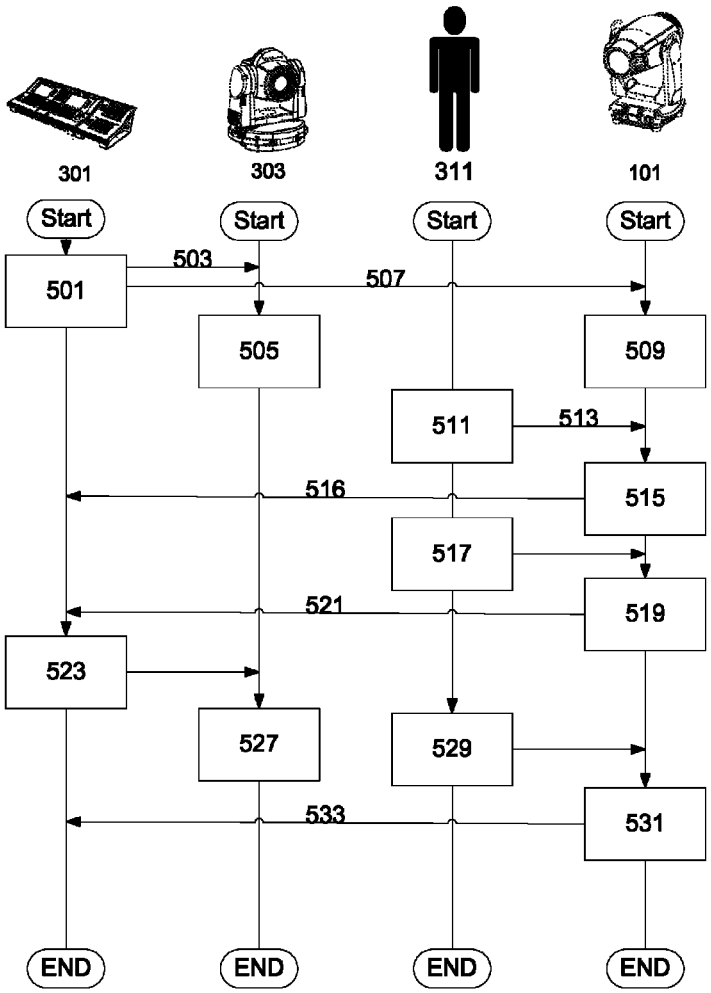
FIG. 5 is a flow diagram illustrating an example of the communication during a light show.

FIG. 5 illustrates an example of the communication during a light show between some of the units in the entertainment system illustrated in FIG. 3. A part of the light show needs the follow spot function of at least one moving head. The light controller starts the light show in step 501 and will thus send 503 instructions to a number of moving heads according to prior art 303 and the moving heads according to prior art will in step 505 perform the instruction, e.g. change optical effect or position. The light controller sends 507 similar instructions to a moving head 101 according to the present invention and this moving head does also act as instructed 509. The light controller sends instructions the two kinds of moving head continuously during the light show and the moving heads will thus act corresponding to the these instructions. A person 311 switches 511 the moving head 101 according the present invention into follow spot mode. E.g. by using 513 interaction means on this moving head. However the light controller can alternatively instruct the moving head 101 to switch into follow spot mode and the person does in this case not need to interact with the user interaction means of the moving head. The moving head 101 will react on this instruction by deactivating the rotation means 515 as described above. The moving head 101 can also send a message 516 to the light controller telling the light controller that it have been switched into follow spot mode. The person 311 can now move 517 the moving head 101 manually. The moving head 101 reads the position of the head in relation the yoke and the position of the yoke in relation to the base 519 using the position encoders as described above and sends these positions to the light controller 521. The light controller then instructs 523 the other moving heads 303 based on the received position and the other moving heads 303 acts according to this instruction 527. It is hereby possible to move the other moving heads in the entertainment system based on the manual movement of the follow spot moving head 101. The person skilled in the art would realizes that the light controller can calculate the position of each of the other moving heads in the entertainment system individually based on the revived position, as the position/movement of the other moving heads, might be offset from the position/movement of the follow spot moving head 101, e.g. due to the physical position of the moving heads. The person 311 switches 529 the moving head 101 into normal mode of operation and the moving head then reacts on this instruction by deactivating 531 the rotation means 515 as described above and sending 533 information to the light controller that it is in normal mode of operation. The light controller can now continue the light show in automatic mode and control the entertainment system as known in the prior art.

The synchronization function where the other moving heads are controlled based on position of a first moving head 101 can in short be described as: A method of controlling a number of moving heads comprising the steps of:

manually moving a one moving head;

determining the position of said first moving head;

automatically moving a second moving head based said position of said first moving head.

The position of the first moving head can for instance indicant the position of the head in relation to the yoke or the position of the yoke in relation to the base. This method can be implemented into the illustrated entertainment system.

The invention claimed is:

1. A moving head light fixture comprising:

a base a yoke rotatable connected to said base, a head rotatable connected to said yoke, said head comprises at least one light source generating a light beam, first rotating means for rotating said yoke in relation to said base, second rotating means for rotating said head in relation to said yoke, controlling means adapted to control said light effect means based on an input signal, said input signal indicative of at least one light effect parameter, controlling means adapted to control said at least said first rotating means or said second rotating means based on said input signal, said input signal being further indicative of at least one position parameter, said position parameter is indicative of at least one position parameter, said position parameter is indicative of at least a position of said yoke in relation to said base or a position of said head in relation to said yoke, wherein that said moving head further comprises switching means for switching said moving head between a normal mode of operation and a follow spot mode of operation, said follow spot mode of operation being characterized in that at least said first rotating means or said second rotating means being deactivated while said controlling means adapted for control said light effect means remains at least partially activated.

2. A moving head light fixture according to claim 1 wherein that said follow spot mode further being characterized in that at least said yoke manually can be moved in relation to said base or said head manually can be moved in relation to said yoke.

3. A moving head light fixture according to claim 1 wherein characterized in that said switching means deactivates said at least first rotating means or said second rotating means in said follow spot mode by deactivating said controlling means adapted to control said at least said first rotating means or said second rotating means.

4. A moving head light fixture according to claim 3 wherein that said controlling means controlling said at least said first rotating means or said second rotating means is adapted to ignore said position parameter.

5. A moving head light fixture according to claim 1 wherein that said switching means in said follow spot mode is adapted to reduce electrical power supplied to at least said first rotating means or said second rotating means.

6. A moving head light fixture according to claim 1 wherein that said switching means deactivates said at least said first rotating means or said second rotating means in said follow spot mode by disconnecting electrical power supplied to at least said first rotating means or said second rotating means.

7. A moving head light fixture according to claim 1 wherein that said moving head light fixture comprises user interacting means connected to said switching means, said user interacting means is adapted to activate said switching means.

8. A moving head light fixture according to claim 1 wherein that said switching means responds to said input signal and in that said input further indicative of at least one mode of operation parameter.

9. A moving head light fixture according to claim 1 wherein that said moving head further comprises communication means adapted to send at least one output signal through a communication channel.

10. A moving head light fixture according to claim 1 wherein that said moving head further comprises position encoding means determining at least the position of said yoke in relation to said base or the position of said head in relation the yoke.

11. A moving head light fixture according to claim 1 wherein that said controlling means controlling said light effect means is adapted to ignore at least one of said light effect parameters of said input signal.

12. A moving head light fixture according to claim 11 wherein that said head light fixture comprises user interacting means adapted to provide an input signal substituting said ignored light effect parameters.

13. An entertainment system comprising a light controller connected to at least one moving head light fixture through a communication channel, said moving head light fixtures comprise:

a base a yoke rotatable connected to said base a head rotatable connected to said yoke, said head comprises at least one light source generating a light beam, light effect means adapted to modify said light beam, first rotating means for rotating said yoke in relation to said base, second rotating means for rotating said head in relation to said yoke, controlling means adapted to control said light effect means based on an input signal, said input signal indicative of at least one light effect parameter, controlling means adapted to control said at least said first rotating means or said second rotating means based on said input signal, said input signal being further indicative of at least one position parameter, said position parameter is indicative of at least a position said yoke in relation to said base or a position of said head in relation to said yoke, said light controller controls said at least one moving head light fixture by sending said input signal to said moving head light fixture through said communication channel.

wherein that at least a first moving head light fixtures comprises switching means for switching said moving head between a normal mode of operation and a follow spot mode of operation, said follow spot mode of operating being characterized in that at least said first rotating means of second rotating means being deactivated while said controlling means adapted for control said light effect means remains activated.

14. An entertainment system according to claim 13 wherein that said follow spot mode further being characterized in that at least said yoke manually can be moved in relation to said base or said head manually can be moved in relation to said yoke.

15. An entertainment system according to claim 13 wherein that said first moving head light fixture comprises user interacting means connected to said switching means, said user interacting means is adapted to activate said switching means.

16. An entertainment system according to claim 13 wherein that said switching means responds to said input signal and in that said input signal further is indicative of at least one mode of operation parameter.

17. An entertainment system according to claim 13 wherein that said moving head further comprises communication means adapted to send at least one output signal through said communication channel.

18. An entertainment system according to claim 13 wherein that said first moving head further comprises position encoding means determining at least the position of said yoke in relation to said base or the position of said head in relation the yoke.

19. An entertainment system according to claim 17 wherein that said output signal is indicative of at least said position of said yoke in relation to said base or said position of said head in relation the yoke.

20. An entertainment system according to claim 19 wherein that said entertainment system comprises at least a second moving head and in that at least said first rotating means or said second rotating means of said second moving head light fixture being controlled based on at least said output signal.

21. A method of controlling a moving head light fixture, said moving head light fixture comprising:

a base, a yoke rotatable connected to said base, a head rotatable connected to said yoke, said head comprises at least one light source generating a light beam, light effect means adapted to modify said light beam, first rotating means for rotating said yoke in relation to said base, second rotating means for rotating said head in relation to said yoke, controlling means adapted to control said light effect means based on an input signal, said input signal indicative of at least one light effect parameter, controlling means adapted to control said at least said first rotating means or said second rotating means based on said input signal, said input signal being further indicative of at least one position parameter, said position parameter is indicative of position of at least said yoke in relation to said base or position of said head in relation to said yoke, switching means for switching said moving heads between a normal mode of operation and a follow spot mode of operation, said follow spot mode of operation being characterized in that at least said first rotating means or said second rotating means being deactivated while said controlling means adapted for control said light effect means remains activated;

said method comprises the step of switching said switching means between said normal mode of operation and said follow spot mode of operation, said follow spot mode of operation being characterized in that at least said first rotating means or said second rotating means being deactivated while said controlling means adapted for control said light effect means remains at least partially activated.

22. A method according to claim 21 wherein that said method comprises at least one of the steps of:

manually moving said yoke in relation to said base or manually moving said head in relation to said yoke.

23. A method of claim 21 wherein that said method comprises at least one of the steps of:

controlling at least one of said light effect means based on said an light effect parameter of said input signal.

24. A method according to claim 23 wherein that said method comprises at least one of the steps of:

ignoring at least one of said light effect parameters of said input signal;

manually controlling at least one of said light effect means controlled by said ignored light effect parameters.

* * * * *